US005088678A

United States Patent [19]

Bitan

[11] Patent Number: 5,088,678

[45] Date of Patent: Feb. 18, 1992

[54] MULTI-STATION EASEL

[76] Inventor: Nachum Bitan, 21 Bunker Hill Dr., Toms River, N.J. 08755

[21] Appl. No.: 557,686

[22] Filed: Jul. 25, 1990

[51] Int. Cl.[5] ..... A47B 97/08

[52] U.S. Cl. ..... 248/460; 248/441.1

[58] Field of Search ..... 248/460, 441.1, 451; 211/189; 160/135; 312/230, 265.5, 263, 257.1

[56] References Cited

U.S. PATENT DOCUMENTS

| | | | |
|---|---|---|---|
| 1,129,040 | 2/1915 | McClure | 312/263 X |
| 2,279,864 | 4/1942 | Eide | 211/189 |
| 3,282,437 | 11/1966 | Hansen | 248/460 |
| 3,603,656 | 9/1971 | Ferman | 312/230 X |
| 3,692,273 | 9/1972 | Woolman | 248/460 |
| 3,931,894 | 1/1976 | Murphy | 211/189 |
| 4,378,102 | 3/1983 | Portis, Jr. et al. | 248/451 X |
| 4,427,391 | 1/1984 | Berman | 312/230 X |
| 4,582,002 | 4/1986 | Wright | 211/189 X |
| 4,618,120 | 10/1986 | Wattles | 248/460 |
| 4,832,421 | 5/1989 | Shoffner | 312/265.5 X |

FOREIGN PATENT DOCUMENTS

| | | | |
|---|---|---|---|
| 1137790 | 6/1957 | France | 312/265.5 |

*Primary Examiner*—Carl D. Friedman
*Assistant Examiner*—Derek J. Berger
*Attorney, Agent, or Firm*—Arthur L. Plevy

[57] ABSTRACT

A device for supporting drawing media which includes an easel for permitting simultaneous use by more than one person and having at least three side panels. Each side panel has a substantially planar front face and rear face, a bottom edge, and two side edges, the edges forming at least a portion of the periphery of the panel. The panels has disposed proximate to one side edge thereof, means for removably interlocking with mating interlocking means disposed proximate a second side edge of another panel. When interlocked, the panels form a hollow polygon with an open bottom, each facet of the polygon constituting a surface for supporting media to be drawn upon. Alternatively, the panels can be directly drawn upon and erased.

12 Claims, 3 Drawing Sheets

MULTI-STATION EASEL

BACKGROUND OF THE INVENTION

1. Field of the Invention

The present invention relates to an easel for supporting media to receive artwork, and more particularly to a multi-station easel for simultaneous use by more than one person.

2. Description of the Prior Art

Easels for supporting artwork have been known for centuries. The common easel is essentially a tripod having a set of foldable and/or telescoping legs, to which is attached a flat board with a bottom ledge. The board serves as a surface for supporting media such as paper or canvas to be drawn or painted upon by an artist. The easel holds the drawing media at an angle and at a height which facilitates comfortable drawing and provides a sturdy mechanical support that does not move under the pressure of pen or paint brush. Easels are designed to be light in weight and portable to allow them to be carried to various locations, such as, a site that is to be depicted in a painting, but yet must provide adequate support. Known easels are designed for use by only one person at a time, are relatively complex and expensive, and are not appropriate for use by children. Other known easel-like drawing supports, such as drafting tables, are similarly designed for use by one individual at a time, are complex and expensive, and tend therefore to rarely be used by children.

SUMMARY OF THE INVENTION

The problems and disadvantages associated with the conventional techniques and devices utilized to provide support for drawing media are overcome by the present invention which includes an easel for permitting simultaneous use by more than one person. The easel includes at least three side panels. Each side panel has a substantially planar front face and rear face, a bottom edge, and two side edges, the edges forming at least a portion of the periphery of the panel. Each of the panels has disposed proximate to one side edge thereof, means for removably interlocking with mating interlocking means disposed proximate a second side edge of another panel. When interlocked, the panels form a hollow polygon with an open bottom, each facet of the polygon constituting a surface for supporting media to be drawn upon. Alternatively, the panels can be directly drawn upon and erased.

The present invention thereby provides a simple, sturdy, economical multi-station easel which serves as a focal point for more than one child artist thereby saving space and at the same time promoting the communal experience of the children who perform their creative work at a common easel.

BRIEF DESCRIPTION OF THE FIGURES

For a better understanding of the present invention, reference is made to the following detailed description of an exemplary embodiment considered in conjunction with the accompanying drawings, in which.

DETAILED DESCRIPTION OF THE FIGURES

Figure 1:
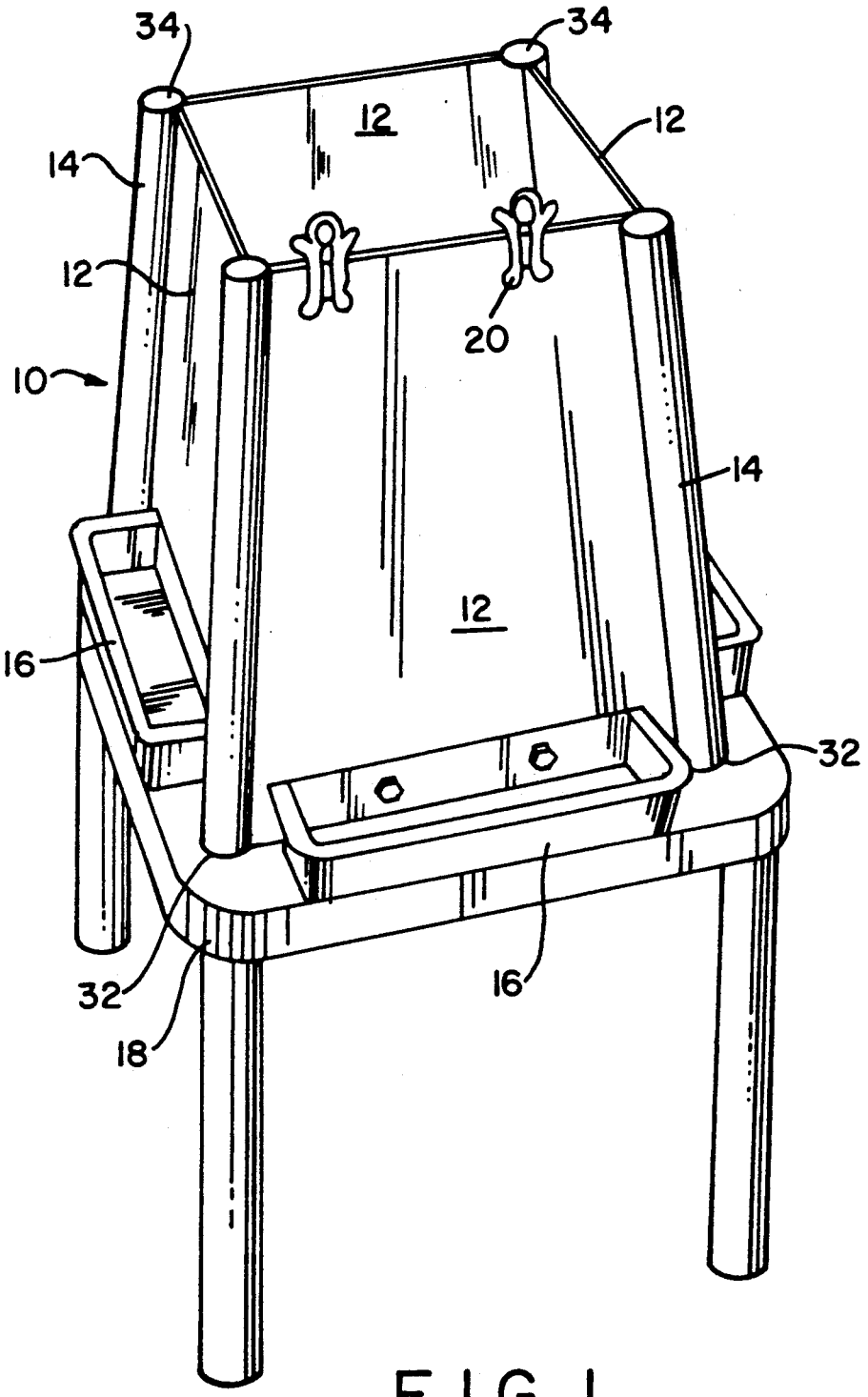
FIG. 1 is a perspective view of an exemplary embodiment of the present invention placed upon a supporting table.

Referring to FIG. 1, a multi-station easel 10 in accordance with the present invention is shown. The easel 10 has four generally trapezoidal side panels 12 for supporting drawing media such as paper or cardboard and/or to be drawn or painted upon directly. The two non-parallel side edges of the panels 12 are joined by interlocking tabs and grooves to the non-parallel edges of adjacent panels 12 as shall be more fully described in reference to FIGS. 2 and 3*a–c*. Although any number of panels 12 equal to or in excess of three could be provided to render a hollow polygon and to enable a corresponding number of children to simultaneously draw, four panels is the preferred number, as it provides a compact configuration while still providing adequate panel surface area and proper angular displacement of the panels from the vertical for comfortable drawing. The inward inclination of the panels 12 also lessens the likelihood that paints applied to the panels or to sheets supported thereon will run. The side panels 12 are preferably constructed from a tough, impermeable, opaque or transluscent polymeric material, such as, high density polyethylene, which can serve merely as a smooth, flat support for a drawing paper, cardboard or canvas, or which can be written or painted upon directly and can be erased by washing with a damp sponge or by passing a rag or eraser over the surface. Alternatively, the panels 12 can be of laminate construction having, e.g., a wood product core, e.g., particle or wafer board, and hard outer layers composed, e.g., of melamine. The interlocking juncture between panels 12 is covered and secured by edge covers 14 which are slideably received over the interlocking panel 12 edges and assist in retaining the interlocked position by friction as shall be further described below. The edge covers also give the easel 10 a finished appearance and generally enhance its aesthetic appeal. Each panel 12 may be provided with a removeable supply tray 16 for holding art supplies, such as, paints, brushes, crayons, etc. The bottom of the supply tray 16 is held parallel to the ground by means of a slanted rear wall which is inclined beyond ninety degrees relative to the bottom of the tray to the same degree that the panels 12 are inclined from the vertical. The trays 16 may be held to the panels by a variety of conventional means but a large plastic bolt and mating wing nut have been found to be both practical and appealing to children. The easel 10 can be placed on a table 18 to elevate it to a height where children can conveniently stand, or with small children, the easel could be placed directly on the floor. A plurality of clips 20 having a fanciful design and dimensioned to accommodate the thickness of the panels and a sheet of drawing material therebetween may be provided to assist in holding artwork on the easel. Of course, clips 20 of this type could only be used if the easel 10 has an open top, and would not be appropriate for, say, a pyramidal easel.

Figure 2:
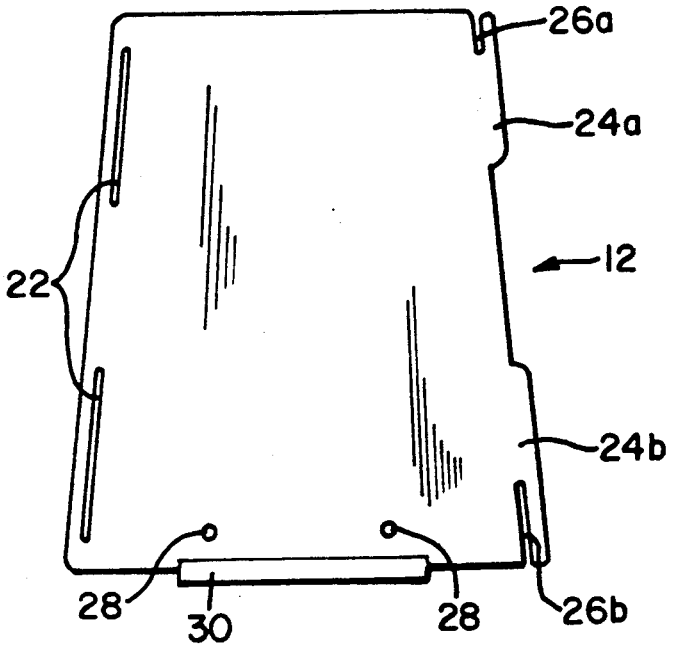
FIG. 2 is a side view in elevation of a single side panel of the device of FIG. 1.

Referring now to FIG. 2, a side view of one of the support panels 12 reveals that each panel has a pair of elongated slots 22 disposed proximate and parallel to one of the non-parallel side edges (of the trapezoidal panel 12) and a pair of tabs 24a and 24b extending from the other. Each tab 24a and 24b are partially cleaved from the panel 12 by notches 26a and 26b. The notch 26b in the lower tab 24b is deeper than the notch 26a in the upper tab 24a to enable assembly as shall be more fully explained with reference to FIGS. 3a–3c. If both planar surfaces, i.e., front and back, of the support panels 12 are equally suitable for use as a drawing support and/or drawing surface, no convention as to the location of the slots 22 and tabs 24a and 24b on a particular side need be observed, as the panels would be reversible. If, on the other hand, the panels 12 have specialized front and back surfaces, e.g., only the front face is suitable to be drawn upon, the slots 22 and tabs 24a and 24b could be disposed proximate either the right or left edge of the panels 12, but each panel must have the same edge used consistently. It is preferred that the panels 12 be formed from a material that provides suitable characteristics for drawing upon without gluing or laminating other materials thereto, but the scope of the present invention encompasses such a construct. A pair of mounting holes 28 are formed proximate a lower edge of the panels 12 for receiving fasteners such as plastic through-bolts for holding the supply trays 16 to the panels. A split rubber bumper 30 press fits along the lower edge of the panels and is retained there by friction. The rubber bumper 30 increases the frictional hold of the device on a supporting surface such as a table as shown in FIG. 1 and thereby prevents the easel from being inadvertently moved by one user to the consternation of another.

Figure 3A:
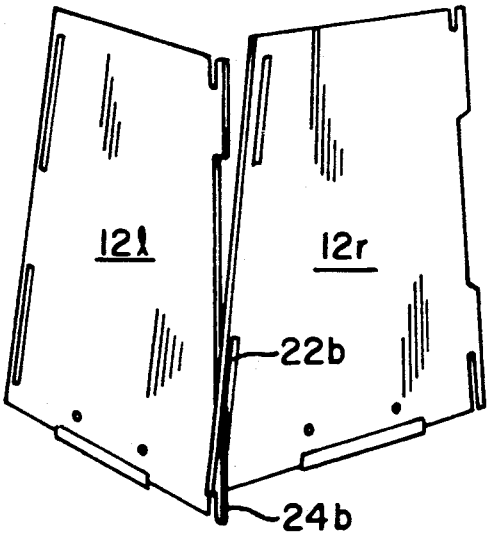
FIGS. 3*a* through 3*c* are a series of progressive partial perspective views of the assembly of the device of FIG. 1 illustrating how a pair of side panels are assembled by interlocking tabs and slots.
Figure 3B:
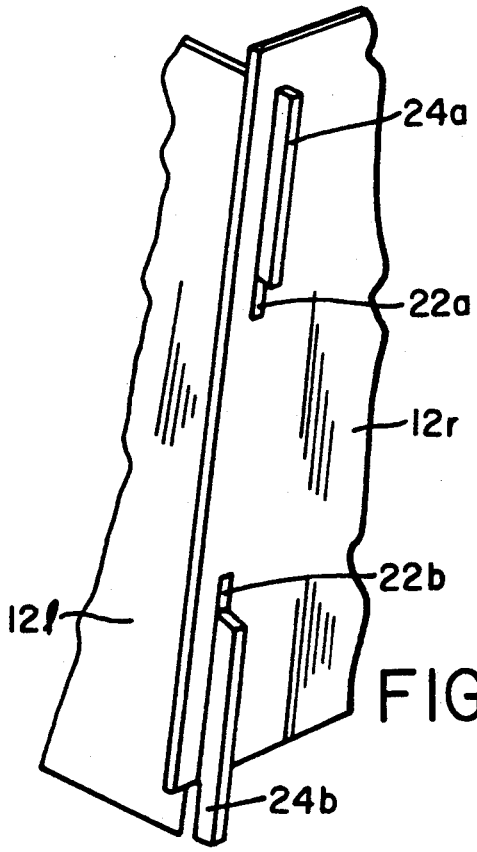
Figure 3C:
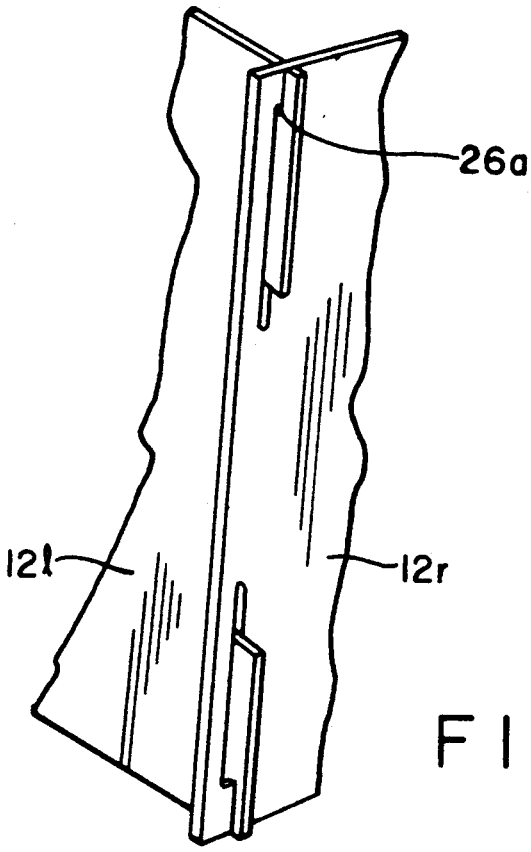

Referring now to FIGS. 3a through 3c, the assembly of the panels one to another can be more fully appreciated. In FIG. 3a the lower tab 24b of one of the panels 12L is shown inserted into the lower slot 22b of another panel 12r. The deeper lower notch 26b allows the panel 12L to be slid within the lower slot 22b of panel 12r to permit the upper tab 24a of panel 12L to enter the upper slot 22a of panel 12r upon pivoting panel 12L towards panel 12r as shown in FIG. 3b. To complete the interlocking of panels 12L and 12r, panel 12r is slid downwards relative to panel 12L, as shown in FIG. 3c, such that it engages in the upper notch 26a of panel 12L.

Figure 4:
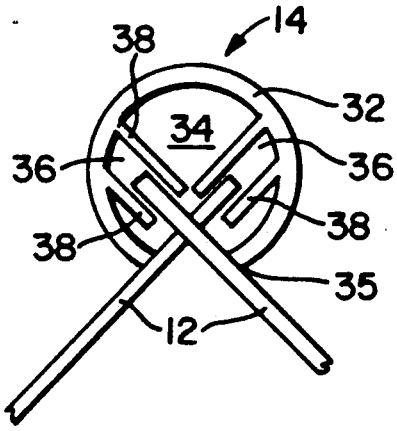
FIG. 4 is a bottom plan view of a corner sleeve in place upon the interlocking junction of two side panels of the device of FIG. 1.

As shown in FIG. 4, the interlocking of panels 12 is further secured by the installation of edge covers 14 at the juncture thereof. The edge covers 14 in the embodiment shown are hollow cylindrical members having an open end 32 and a capped end 34. A slot 35 is formed through the sidewall of the cover 14 which extends from the capped end 34 to the open end 32. The capped end is not slotted, and when in place, abuts the upper edge of the panels 12 upon which it is installed as shown in FIG. 1. A pair of channels 36 the interlocked panel 12 edges. The edge covers 14 are installed on each interlocked junction after the panels are interlocked as described above in reference to FIGS. 3a–3c, and are preferably formed from a tough, resilient polymeric material. The dimensions of the sidewall slot and inwardly extending partitions should be selected to provide a firm but removeable friction fit upon the interlocked junction of panels 12. Although cylindrical edge covers 14 are shown, covers having other geometric shapes could be used as well, such as, those having a rectangular or triangular configuration. In the eventuality that triangular side panels 12 are utilized to render a pyramidal easel 10, the edge covers 14 would be angled to a point where they would meet at the common apex. For a pyramidal configuration, the edge covers 14 could not have a closed top end and either would have a closed bottom end or, alternatively, neither end would be closed.

It should be apparent from the foregoing description that the present invention provides a simple, sturdy, economical easel for simultaneous use by more than one person. The interlocking construction of the present invention allows it to be easily assembled for use and disassembled for storage, the disassembled easel occupying a relatively small space as it stores flat. The assembly and diassembly processes are simple enough that the children who will use the device can participate in putting it together and taking it apart for storage after use. These activities provide a lesson in mechanics and coordination as well as an opportunity to realize the value of cooperation. The present invention is particularly appropriate for use by children as it enhances the communal nature of a task undertaken by more than one child by causing them to gather around a common easel, while at the same time preserving an individual workspace for each child as they perform their unique artwork. It should be understood that the embodiments described herein are merely exemplary and that a person skilled in the art may make many variations and modifications without departing from the spirit and scope of the invention as defined in the appended claims.

I claim:

1. An easel for simultaneous use by more than one person comprising:

a) four substantially identical side panels, each having a substantially planar front face and rear face, a bottom edge, a side edge and another side edge, said side edges being equal in length and being displaced an equal number of degrees from said bottom edge, said edges forming at least a portion of the periphery of each of said panels, said planar faces of each of said panels having a trapezoidal profile;

b) each of said panels having disposed proximate to said side edge thereof means for removably interlocking with mating interlocking means disposed proximate said another side edge of another said panel of said four panels, said four panels when interlocked forming a hollow polyhedron with an open bottom, said interlocking means including at least one tab projecting in the plane of said panel from said side edge, said tab partially separated from said panel for a portion of the length of said tab by a notch extending parallel to said side edge, said notch having a width approximating the thickness of said panel from said front face to said back face, said mating interlocking means including at least one slot-like orifice into which said tab may be slideably introduced, said notch accommodating said panel proximate said orifice when said panels are interlocked, said panels when interlocked each being inclined inwardly away from the vertical in the direction from said bottom edge to a top edge of said trapezoidal panel, said top edges of said panels providing said polyhedron with an open top; and c) means for removably covering said side and said another side edges of said interlocked panels at a juncture of said panels and external to said hollow polyhedron after said panels have been interlocked, said covering means restraining said panels from becoming disengaged and including a hollow, substantially cylindrical member having an open end and a closed end and a slot extending from said closed end to said open end permitting said cylindrical member to slide over and cover said juncture of said interlocked panels, said cylindrical member including a pair of channels formed by partitions extending inwardly from the interior of said cylindrical member, said channels slideably receiving therein said side edge and said another side edge of a pair of interlocked panels when said covering means is slid over said juncture of a pair of interlocked panels, said closed end abutting said upper edge of said interlocked panels proximate said juncture.

2. The device of claim 1, wherein said at least one tab and said at least one slot-like orifice are at least two in number and wherein a first said tab is disposed proximate said top edge and a second said tab is disposed proximate said bottom edge, said notch of said first tab extending from said top edge downward toward said bottom edge, said notch of said second tab extending from said bottom edge toward said top edge to a greater degree than said notch in said first tab extends downwardly.

3. The device of claim 1, further including an elastic number affixed to said bottom edge of each of said panels, said bumper providing an increased frictional coefficient to prevent said easel from sliding upon a surface supporting it.

4. The device of claim 1, wherein said front face and said rear back face are interchangeable and each of said panels is reversible.

5. The device of claim 1, wherein said panels are formed at least partially from polymeric material.

6. The device of claim 5, wherein said polymeric material is high density polyethylene.

7. The device of claim 5, wherein said panels are constructed from a wood product core overlayed with layers of melamine.

8. An easel for simultaneous use by more than one person comprising:

a) four substantially identical side panels which can receive graphic indicia directly thereon and which is erasable from said panels, each of said side panels having a substantially planar front face and rear face, a bottom edge, a side edge and another side edge, said side edges being equal in length and being displaced an equal number of degrees from said bottom edge, said edges forming at least a portion of the periphery of each of said panels, said planar faces of each of said panels having a trapezoidal profile;

b) each of said panels having disposed proximate said side edge thereof means for removably interlocking with mating interlocking means disposed proximate said another side edge of another said panel of said four panels, said four panels when interlocked forming a hollow polyhedron with an open bottom, wherein said panels when interlocked are each inclined inwardly away from the vertical in the direction from said bottom edge to a top edge of said trapezoidal panel, said top edges of said panels providing said polyhedron with an open top, said interlocking means including at least two tabs projecting in the plane of said panel from said side edge, wherein a first of said at least two tabs is disposed proximate said top edge and a second of said at least two tabs is disposed proximate said bottom edge, each of said at least two tabs being partially separated from said panel for a portion of the length of said tabs by a notch extending parallel to said side edge, said notch of said first tab extending from said top edge downward toward said bottom edge, said notch of said second tab extending from said bottom edge toward said top edge to a greater degree than said notch in said first tab extends downwardly, and said notch of said first and second tabs having a width approximating the thickness of said panel from said front face to said rear face, and wherein said mating interlocking means includes at least two slot-like orifices into which said at least two tabs may be slideably introduced, said notch of said first and second tabs accommodating said panel proximate said orifices when said panels are interlocked, and wherein said front face and said rear face are interchangeable and each of said panels is reversible, c) means for removably covering said side and said another side edges of said interlocked panels at a juncture of said panels and external to said hollow polyhedron after said panels have been interlocked, said covering means restraining said panels from becoming disengaged and including a hollow, substantially cylindrical member having an open end and a closed end and a slot extending from said closed end to said open end permitting said cylindrical member to slide over and cover said juncture of said interlocked panels, said cylindrical member including a pair of channels formed by partitions extending inwardly from the interior of said cylindrical member, said channels slideably receiving therein said side edge and said another side edge of a pair of interlocked panels when said covering means is slid over said juncture of a pair of interlocked panels, said closed end abutting said upper edge of said interlocked panels proximate said juncture.

9. An easel for simultaneous use by more than one person comprising:

a) four side panels, each having a substantially planar front face and rear face, a bottom edge, a side edge and another side edge, said edges forming at least a portion of the periphery of each of said panels, said planar faces of each of said panels having a trapezoidal profile;

b) each of said panels having disposed proximate to said side edge thereof means for removably interlocking with mating interlocking means disposed proximate said another side edge of another said panel of said four panels, said four panels when interlocked forming a hollow polyhedron with an open bottom, said interlocking means including at least one tab projecting in the plane of said panel from said side edge, said tab partially separated from said panel for a portion of the length of said tab by a notch extending parallel to said side edge, said notch having a width approximating the thickness of said panel from said front face to said back face, said mating interlocking means including at least one slot like orifice into which said tab may be slideably introduced, said notch accommodating said panel proximate said orifice when said panels are interlocked, said panels when interlocked each being inclined inwardly away from the vertical in the direction from said bottom edge to a top edge of said trapezoidal panel, said top edges of said panels providing said polyhedron with an open top;

(c) means for removably covering said side and said another side edges of each of said interlocked panels at a juncture of said panels and external to said hollow polyhedron after said panels have been interlocked, said covering means restraining said panels from becoming disengaged and including a hollow, substantially cylindrical member having an open end and a closed end a slot extending from said closed end to said open end permitting said cylindrical member to slide over and cover said juncture of said interlocked panels, said cylindrical member including a pair of channels formed by partitions extending inwardly from the interior of said cylindrical member, said channels slideably receiving therein said side edge and said another side edge of a pair of interlocked panels when said covering means is slid over said juncture of a pair of interlocked panels, said closed end abutting said upper edge of said interlocked panels proximate said juncture.

10. The device of claim 9, further including a supply tray for containing art supplies removably affixed to each of said panels, said supply tray extending outwardly from said panels parallel to ground level.

11. The device of claim 9, wherein said panels can receive graphic indicia directly thereon, said indicia being erasable from said panels, wherein said tabs and said orifices are at least two in number, a first said tab being disposed proximate said top edge and a second said tab being disposed proximate said bottom edge, said notch of said first tab extending from said top edge downward toward said bottom edge, said notch of said second tab extending from said bottom edge toward said top edge to a greater degree than said notch in said first tab extends downwardly, and wherein said front face and said rear face are interchangeable and each of said panels is reversible.

12. The device of claim 11, further including an elastic bumper affixed to said bottom edge of each of said panels, and wherein said panels are formed at least partially from polymeric material.

* * * * *